United States Patent [19]

Stahlecker

[11] 4,432,195

[45] Feb. 21, 1984

[54] DEVICE FOR INTERRUPTING THE FEED OF A ROVING TO DRAWING FRAMES

[75] Inventor: Gerd Stahlecker, Geislingen-Stotten, Fed. Rep. of Germany

[73] Assignee: Spindelfabrik Suessen, Schurr, Stahlecker & Grill GmbH, Fed. Rep. of Germany

[21] Appl. No.: 331,281

[22] Filed: Dec. 16, 1981

[30] Foreign Application Priority Data

Dec. 22, 1980 [DE] Fed. Rep. of Germany ..... 3048481

[51] Int. Cl.[3] ..... D01H 13/16; D01H 13/18

[52] U.S. Cl. ..... 57/87; 19/0.25; 57/81

[58] Field of Search ..... 57/80, 84, 86, 87, 81; 19/0.2, 0.21, 0.25, 0.26

[56] References Cited

U.S. PATENT DOCUMENTS 3,695,022 10/1972 Landwehrkamp ..... 57/87 X 4,280,321 7/1981 Marzoli ..... 57/87 X 4,326,371 4/1982 Soar ..... 57/87

*Primary Examiner*—John Petrakes

*Attorney, Agent, or Firm*—Craig & Burns

[57] ABSTRACT

A device is provided for interrupting the feed of a roving to drawing frames on ring spinning machines in response to thread breakage at a respective spinning unit. The device includes a clamping segment annularly clamped about a lower drawing roll and having abutments for selectively lifting the upper drawing roll away from the lower roll to interrupt the feed of roving in response to movement of the clamping segment to an interrupting position. To control the clamping segment, a locking detent lever is provided which is spring-loaded into a locking position engaging the clamping segment and movable to an unlocking position in response to an electrical drive mechanism which, in turn, is controlled by a thread end break detection device. In particularly preferred embodiments, a capacitor is used to energize the drive means to unlock the lever, the capacitor being charged during normal spinning operation and discharged for a preset time period during the unlocking operation.

9 Claims, 5 Drawing Figures

DEVICE FOR INTERRUPTING THE FEED OF A ROVING TO DRAWING FRAMES

BACKGROUND AND SUMMARY OF THE INVENTION

The invention relates to a device for interrupting the feed of a roving to drawing frames of a spinning machine, whereby each spinning frame comprises a plurality of upper and lower drawing rollers, arranged pairwise, of which the lower drawing roller, located on the feed side of the roving, is provided with a clamping segment, said segment being open in the area opposite the upper drawing roller, said segment being protected against driving in the circumferential direction by a locking device, said device being releasable upon a thread break by means of a broken-end detector which monitors the moving thread.

In a known device of the type described hereinabove (Suessen WST, technical report 1.1-01000D9.79) designated a "slubbing stop," the thread is monitored purely mechanically and the roving feed is likewise interrupted purely mechanically. In this design, an annular clamping segment is mounted on the lower drawing roller, facing the feed side of the roving, said segment being held by a locking device during normal operation, thereby being protected against driving by the drawing roller in the circumferential direction. This locking element comprises a two-armed locking lever, whose second arm is associated with a driving device of a thread feeler, so designed that it executes a greater movement upon a thread break and, by virture of its energy of motion, is then in a position to release the locking lever. The known design offers a simple, sturdy solution for interrupting the roving feed. However, operation requires a certain degree of skill and care, since the thread feeler first must be returned by hand into a preliminary position in which the clamping segment in the locking device can be engaged, whereupon the thread feeler is then shifted to the operating position and brought to bear against the moving thread.

An object of the invention is to design a device of the type described hereinabove in such fashion that it permits simpler operation. This object is achieved in especially preferred embodiments of the invention by virtue of the fact that the locking device, which automatically drops into the locking position, is provided with an electric drive, said drive being controllable by the broken-end detector and energizable for a predetermined time interval, said drive operating in the direction of the unlocking position.

Since the electric drive is energized for only a short time interval, i.e., for only the actual unlocking process, the locking device automatically returns to its locking position. This ensures that it can resume its locking function if only the part to be locked, namely the clamping segment, is returned to the initial position. The broken-end detector can be disregarded as the locking position is resumed, since it has no function during this time.

In an advantageous embodiment of the invention, provision is made for the locking device to be provided with a spring drive which acts in the direction of the locking position. This ensures not only an increase in the certainty that the locking device will automatically return to the locking position, but also excludes the possibility of inadvertent unlocking, caused for example, by machine vibrations or the like.

In an advantageous embodiment of the invention, provision is made for the locking device comprising a locking lever swivelable into a latch in the clamping segment, said lever being tensioned by a spring in the direction of the clamping segment and with which an electromagnet is associated, said magnet being controllable by the broken-end detector and lifting the locking lever out of engagement with the clamping segment when excited. In this manner, a simple, sturdy, and reliable locking device is provided.

It is especially advantageous in this connection if the locking lever, its holder, and the holder for the spring and the electromagnet are designed as a module. This makes it possible to retrofit existing drawing frames with a device of this kind in simple fashion, since only one broken-end detector and the module electrically connected therewith need be provided.

Both mechanically acting and other types of broken-end detectors can be provided according to preferred embodiments of the invention, for example, photosensitive broken-end detectors. The latter have the advantage that there is no need for contact with the thread, so that this type of broken-end detector will not respond if the thread tension should slacken slightly when the machine is shut off.

In another embodiment of the invention, provision is made for the broken-end detector to connect the electromagnet with a previously charge capacitor, which discharges through the electromagnet, when a thread break occurs. This capacitor supplies the energy, required only briefly for unlocking, during its discharge. It is especially advantageous in this connection for the broken-end detector to connect the capacitor with a power supply in the operating position. This ensures that the broken-end detector controls the capacitor being recharged in order to keep the device ready for operation at all times.

In another embodiment of the invention, a provision is made for connecting the capacitor with a counter which receives the discharge current as a counting signal. In this way, the number of thread breaks at the individual spinning units can be determined. However, provision can also be made according to the invention, to install only one counter for one machine, to which counter all the capacitors are connected to deliver counting signals. In this manner, the number of thread breaks per machine is counted.

Other features and advantages of the invention will be apparent from the description of the embodiments shown in the drawings.

DETAILED DESCRIPTION OF THE DRAWINGS

Figure 1:
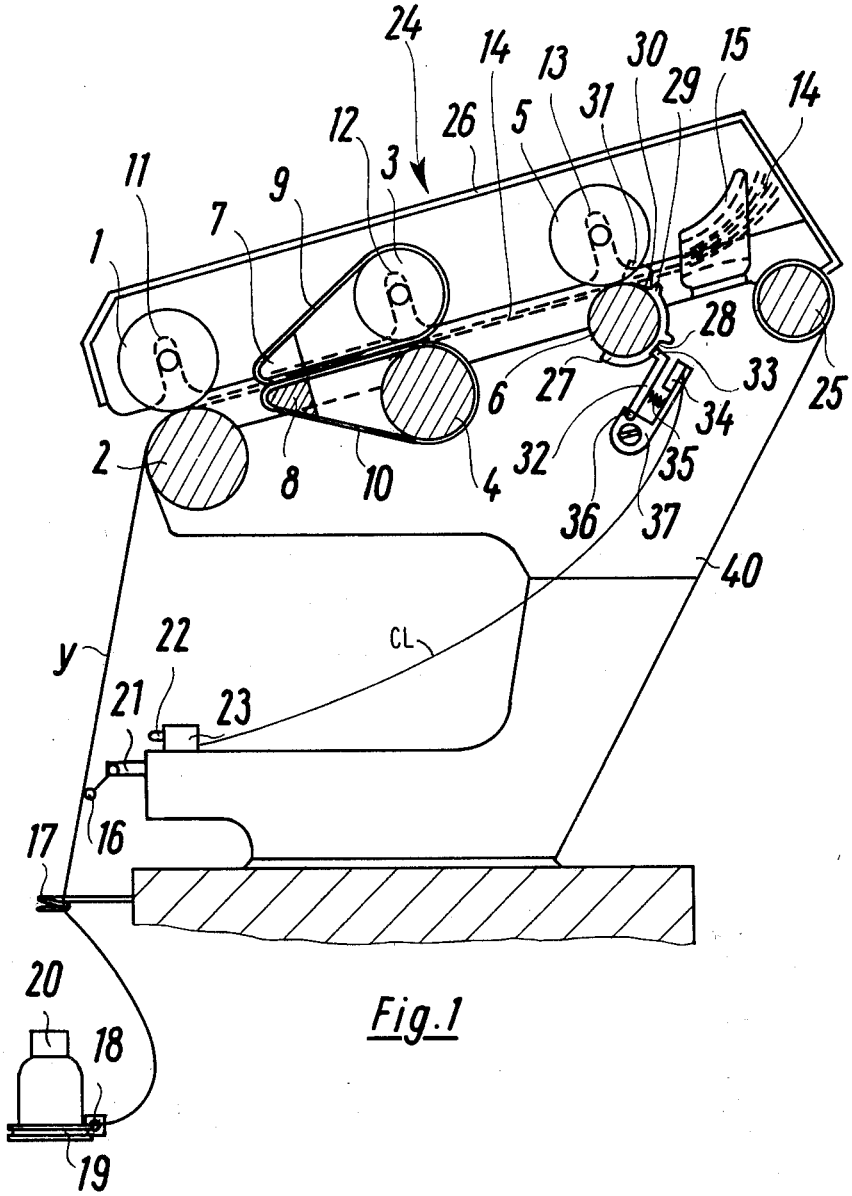
FIG. 1 is a schematic side elevational sectional view of a device according to the invention for a drawing frame on a ring spinning frame, with parts shown in their normal spinning operation positions.

In the following description and in the drawings, only those details of the spinning units and drawing frames necessary to an understanding of the invention are described and shown so as not to obscure the invention. The invention can be adapted to conventional ring spinning frames and the like, as will be readily apparent to those skilled in the art, given the disclosure herein.

Drawing frame 24, shown schematically as an embodiment, is a component of a spinning machine which comprises a plurality of spinning units disposed side by side. One drawing frame 24 of this type is associated with each of these spinning units, said frame comprising two front drawing rollers 1 and 2, two middle drawing rollers 3 and 4, and two rear drawing rollers 5 and 6, located opposite one another pairwise. The middle drawing rollers 3 and 4 are additionally provided with tapes 9 and 10, guided by tape guides 7 and 8. The upper drawing rollers 1, 3 and 5 are mounted displaceably by means of respective spring elements in guides 11, 12 and 13 of a common arm 26, said spring elements pushing them against the respective lower drawing rollers 2, 4 and 6. Lower drawing rollers 2, 4 and 6 are designed in the form of cylinders, composed of a plurality of components and extending along the length of the machine. Upper drawing rollers 1, 3 and 5 preferably share common shafts with drawing rollers disposed in the same relative positions in the adjacent spinning unit, i.e., upper drawing rollers 1, 3 and 5 are combined pairwise on common shafts in an arm 26. Arm 26 is swivelable about a shaft 25, parallel to the roller shafts, so that the drawing frame can be opened.

A roving 14 is fed to the drawing frame via a feed funnel 15, said roving being structured by virtue of the fact that the drawing rollers 3 and 4 turn at a higher rotational speed than drawing rollers 5 and 6 on the feed side and also because drawing rollers 1 and 2 rotate more rapidly than drawing rollers 3 and 4. The roving, stretched and fed by drawing rollers 1 and 2, is spun into a yarn and wound on a bobbin 20, whereby yarn y is guided over a thread-guide eyelet 17 and a traveler 18, disposed on a ring 19 surrounding bobbin 20. Drawing rollers 2, 4 and 6, designed in the form of a continuous cylinder, are driven in known fasion in the machine head.

Drawing frame 24 is equipped with a device to interrupt the feed of roving 14, said device being triggered as a function of a break in yarn y. This device comprises a clamping segment 27, made in the form of a ring segment formed of plastic, clamped onto drawing roller 6 facing the feed side, i.e., feed funnel 15. The clamping segment clamps around slightly more than half of drawing roller 6, and, in the operating position shown in FIG. 1, it is located opposite upper drawing roller 5, so that it does not interfere with the transport of roving 14. Edge 30, which is the leading edge in the direction of rotation of drawing roller 6, is designed as a wedge, delimited by a radially directed stop 29. Tabs 31, directed laterally and radially, are mounted in the vicinity of edge 30, said tabs lying opposite the ends of upper drawing roller 5 and forming a protection against axial displacement. One of the two table 31 is simultaneously designed as a grip tab extending axially toward drawing roller 6. If the clamping segment is not secured in the operating position shown in FIG. 1, it is driven by drawing roller 6 in the rotational direction, whereby wedge-shaped edge 30 slides from below between drawing roller 5 and drawing roller 6, slightly lifting upper drawing roller 5. The driving motion is then limited by stop 29, which strikes upper drawing roller 5. This causes the roving to be clamped between upper drawing roller 5 and the wedge-shaped edge, whereby the drive to the upper drawing roller 5 and hence the transport of roving 14 are interrupted by the lifting of upper drawing roller 5 off lower drawing roller 6. Advantageously, a guide table is provided, in a manner not shown in greater detail, between drawing roller pair 3 and 4 and drawing roller pair 5 and 6, said table supporting the roving 14, located in the area between drawing roller pairs 3 and 4 and 5 and 6.

To ensure the operating position of clamping segment 27, shown in FIG. 1, a locking lever 32, swivelable about a shaft 36 parallel to drawing roller 6, is provided, said lever engaging an axial groove 28 of clamping segment 27 with a nose 33, extending radially to the shaft of drawing roller 6. Locking lever 32 runs approximately tangentially to the limiting edge of groove 28, so that no torque is exerted on nose 33, which projects at 90° from locking lever 32. The locking force acts only in the lengthwise direction of locking lever 32. Axis 36 is mounted on a holder 37 which is screwed to a roller stand 40. Holder 37, with an arm, forms a counter-bearing for a compression spring 35, whose other end abuts locking lever 32, so that this lever has its nose 33 pushed into groove 28 by compression spring 35. The arm of holder 37 also bears an electromagnet 34, associated with the free end of locking lever 32, said magnet being made of a magnetizable material or at least being provided in the vicinity of the nose with an insert which is magnetizable, i.e., responds to magnetic forces.

Figure 2:
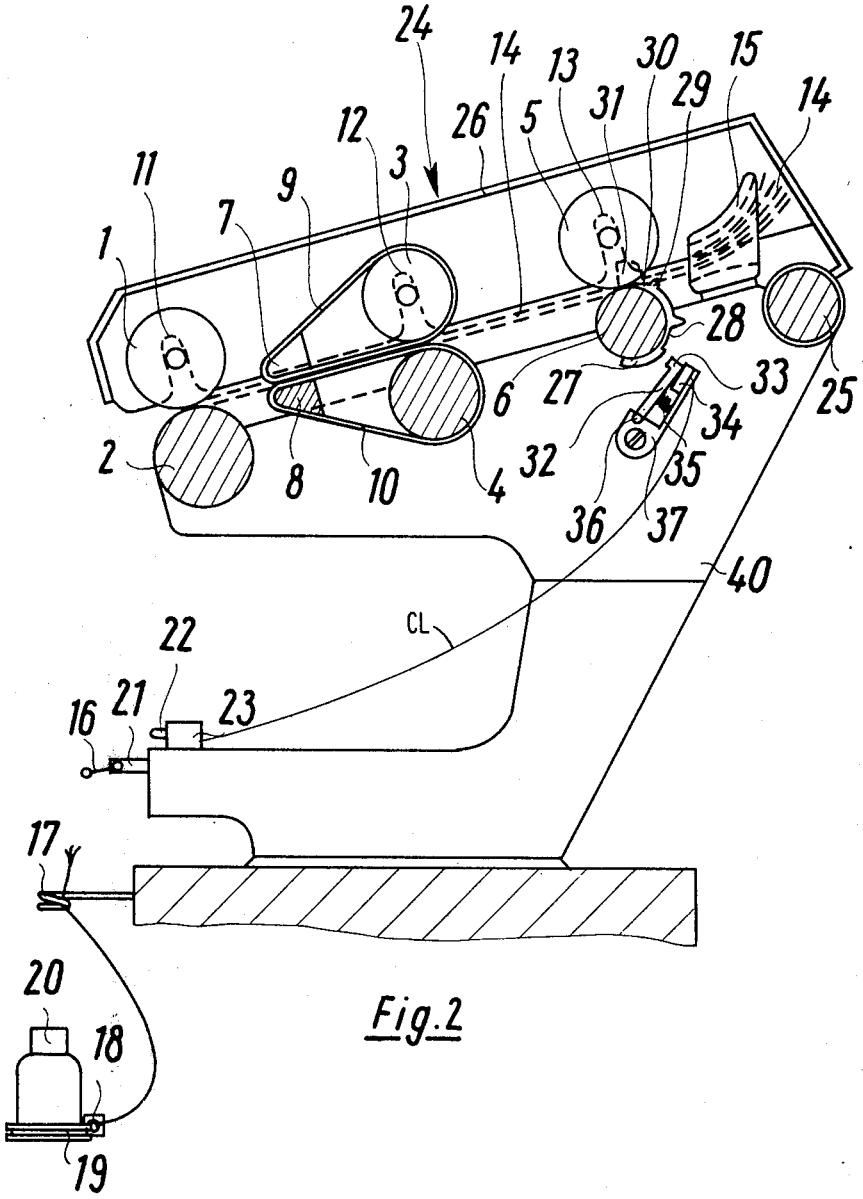
FIG. 2 is a view similar to FIG. 1 but showing the parts at the time of a thread break, or immediately thereafter.
Figure 3:
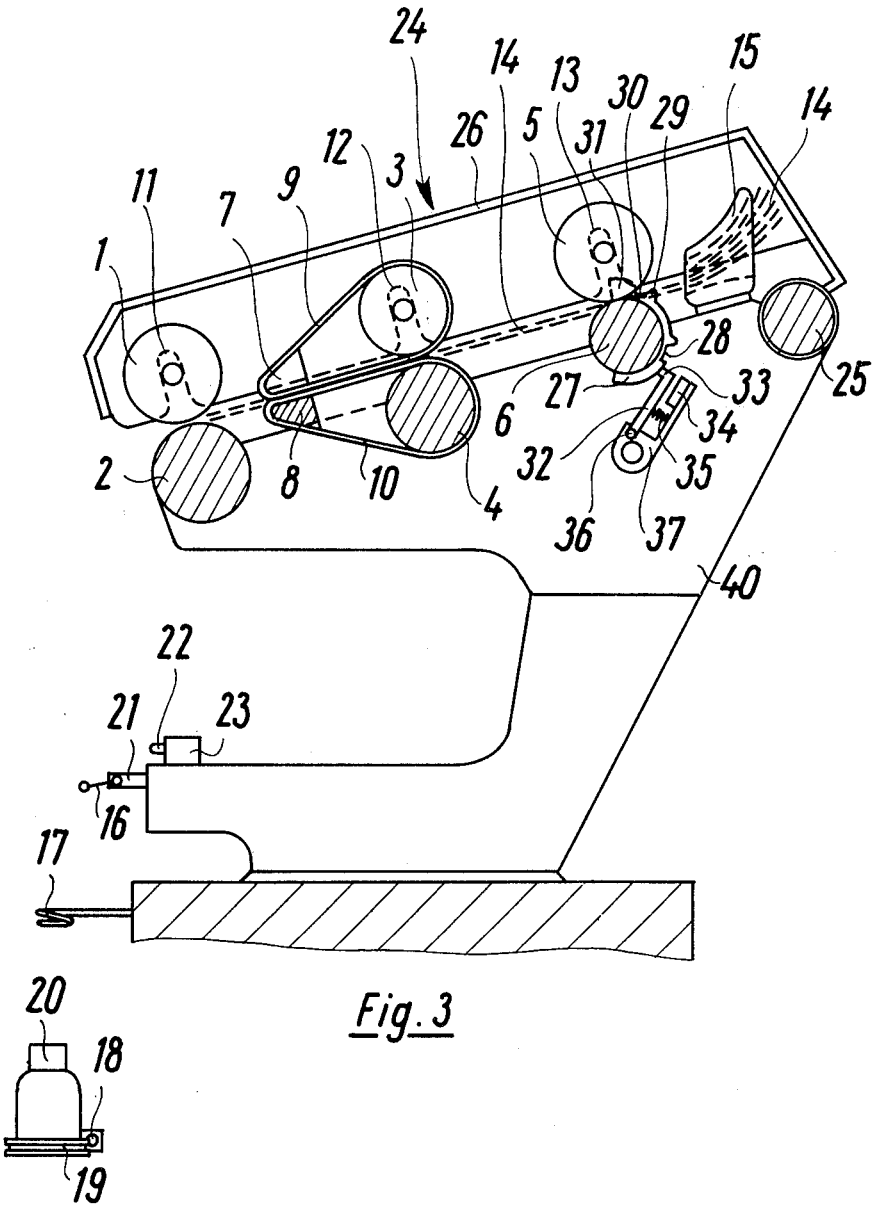
FIG. 3 is a view similar to FIG. 1 but showing the parts after a thread break.

In the event of a yarn break, magnet 34 is briefly excited, so that it pulls nose 33 of locking lever 32 out of groove 28, causing clamping segment 27 to be driven in the rotational direction by drawing roller 6, interrupting the feed of roving 14 in the manner described see (FIG. 2). Excitation of magnet 34 is maintained only briefly so that, after unlocking is complete, locking lever 32 is returned by compression spring 35 to its locking position (FIG. 3). To resume the feed of roving 14, the operator need only turn clamping segment 27 backward by gripping grip tab 31 in the direction opposite to the direction of rotation of drawing roller 6, until nose 33 of locking lever 32 automatically engages groove 28 under the influence of compression spring 35. This can be accomplished very easily with one hand by the operator.

The brief excitation of magnet 34 is controlled by a broken-end detector 21, which in this embodiment is designed as an electric switch, said switch having a feeler lever 16 which contacts yarn y in the area between front drawing roller pair 1 and 2 and guide 17. Instead of a broken-end detector 21 of this type, with a feeler 16, broken-end detectors which operate with zero contact can also be used. In order to ensure that electromagnet 34 will be excited only briefly in the event of a thread break, a provision is made for the broken-end detector to connect the coil of electromagnet 34 to a previously charged capacitor 23 when there is a thread break, said capacitor then discharging through the coil of electromagnetic 34 (FIGS. 4 and 5).

In FIGS. 1 to 3 control line CL is schematically depicted for connecting the electromagnet 34 and capacitor 23. Referring to FIGS. 4 and 5, the broken-end detector is designed as a toggle switch 39, whose switch element 38 connects contacts A and B of a circuit containing a capacitor C to a power supply E in the operating position (FIG. 4). When a thread break occurs, switching element 38 of broken-end detector 21 (FIG. 5) pivots and connects capacitor C with coil L of electromagnet 34 briefly, so that the discharge current from capacitor C briefly excites electromagnet 34. When broken-end detector 21 or its sensing element 16 is returned to the operating position by the yarn (FIG. 4), capacitor C is recharged, so that the device is ready for another cycle.

Figure 4:
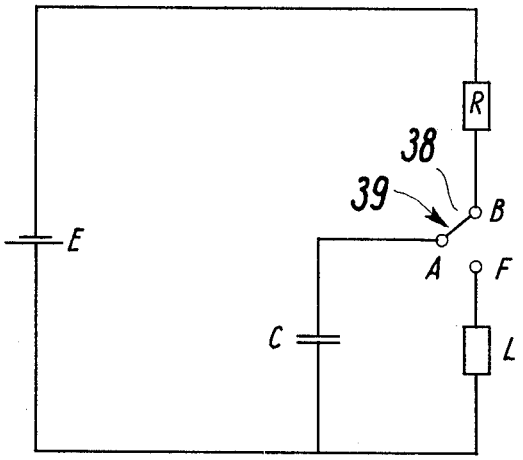
FIGS. 4 and 5 show schematic diagrams for the electric drive of the locking device of the device according to the invention.
Figure 5:
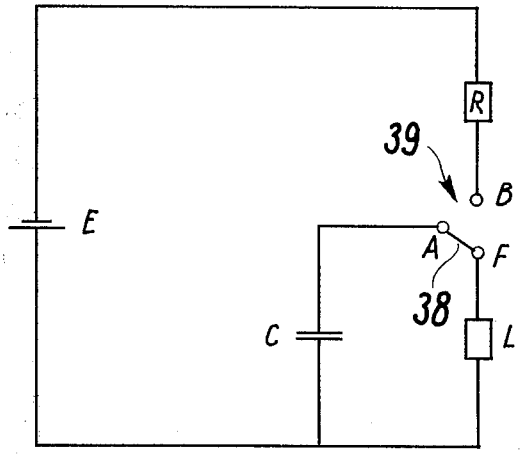

The operator need only concern himself with returning and locking clamping segment 27 in this device, since broken-end detector 21 or its feeler 16 are automatically returned by the newly spun-on yarn to the operating position, whereupon the capacitor is recharged (FIG. 4).

Capacitor 23 is connected to a counter 22, which utilizes the discharge process as a counting pulse, thus recording the occurrence of thread breaks. Provision can also be made for using only one counter 22 for the entire machine, said counter being connected to all capacitors 23 in such fashion that each discharge process of a capacitor triggers a counting pulse, so that the total number of thread breaks in the entire machine is counted.

While I have shown and described various embodiments in accordance with the present invention, it is understood that the same is not limited thereto but is susceptible to numerous changes and modifications as known to one having ordinary skill in the art, and I therefore do not wish to be limited to the details shown and described herein, but intend to cover all such modifications as are encompassed by the scope of the appended claims.

I claim:

1. Device for interrupting the feed of a roving to the drawing frames of a spinning machine of the type having drawing frames which each comprise a plurality of upper and lower drawing rollers disposed pairwise, said device comprising:

a clamping segment including an engagement means located on one of said drawing rollers adjacent the feed side of the roving, said clamping segment being movable from an operative position permitting the driving of said drawing rollers and feed of said roving to an interrupting position interrupting the feeding of said roving, a locking device including a locking lever engageable with said engagement means for maintaining said clamping segment in said operative position, a broken-end detector means for monitoring breaks in thread being spun at the spinning machine, actuator means responsive to a brief input from a control means for controlling disengagement of said locking device from said engagement means, and control means responsive to said broken-end detector means for controlling said actuator means, wherein movement of the clamping segment to said interrupting position is in response to detection of a broken thread by said broken-end detector means.

2. Device according to claim 1, wherein said clamping segment is disposed for circumferential movement around a lower roller, said clamping segment being open in the area opposite the respective adjacent upper roller and being locked by the locking device against circumferential movement away from the operative position, wherein said actuator means includes means for moving said locking device to an unlocking position to permit movement of the clamping segment to said interrupting position, and wherein said actuator means is energizable for a preset time interval in response to detection of a thread break by the broken-end detector means.

3. Device according to claim 2, wherein the locking device is provided with a spring drive acting in the direction of its locking position.

4. Device according to claim 2 wherein the engagement means includes a detent and the locking lever is swivelable into the detent, said lever being tensioned by a spring in the direction of the clamping segment and with said actuator including an electromagnet which is controllable by the control means responding to the broken-end detector, the electromagnet lifts the locking lever out of the detent of the clamping segment, when excited.

5. Device according to claim 4, wherein the locking lever, its holder, and a holder for the spring and the electromagnet are designed as a module.

6. Device according to claim 4, wherein the broken-end detector connects the electromagnet to a capacitor when a thread break occurs, said capacitor being previously charged and discharging through the electromagnet.

7. Device according to claim 6, wherein the capacitor is connected with a counter which receives the discharge current as a counting signal.

8. Device according to claim 6, wherein the broken-end detector means comprises a toggle switch, said switch connecting the capacitor with a power supply during the spinning process and connecting it with the electromagnet upon a thread break.

9. Device according to claim 7 or 8, wherein the locking lever, its holder, and a holder for the spring and the electromagnet are designed as a module.

* * * * *